United States Patent [19]

Young et al.

[11] 4,379,113

[45] Apr. 5, 1983

[54] MELT SPINNING PROCESS FOR ACRYLONITRILE POLYMER FIBER-THREE OR MORE STRETCH STAGES

[75] Inventors: Chi C. Young; Francesco DeMaria, both of Gulf Breeze, Fla.

[73] Assignee: American Cyanamid Company, Stamford, Conn.

[21] Appl. No.: 281,612

[22] Filed: Jul. 9, 1981

[51] Int. Cl.[3] ..... D01F 7/00

[52] U.S. Cl. ..... 264/206; 264/210.7; 264/342 R

[58] Field of Search ..... 264/206, 210.7, 342 R

[56] References Cited

U.S. PATENT DOCUMENTS 4,301,107 11/1981 Kreahling et al. ..... 264/210.7

4,303,607 12/1981 DeMaria et al. ..... 264/210.3

*Primary Examiner*—Jay H. Woo

*Attorney, Agent, or Firm*—Frank M. Van Riet

[57] ABSTRACT

Extrusion of a single phase melt of acrylonitrile polymer and water directly into a steam-pressurized solidification zone and stretching the nascent extrudate in at least three stages while it remains within the solidification zone provides fiber which is readily relaxed.

7 Claims, No Drawings

MELT SPINNING PROCESS FOR ACRYLONITRILE POLYMER FIBER-THREE OR MORE STRETCH STAGES

This invention relates to an improved process for melt-spinning a single phase fusion melt of acrylonitrile polymer and water to form fiber. More particularly, this invention relates to such a process wherein the fusion melt is extruded through a spinneret directly into a steam-pressurized solidification zone wherein the nascent extrudate is subjected to at least three stages of stretching.

Recent developments in the field of acrylonitrile polymer have led to a spinning process wherein a fusion melt of acrylonitrile polymer and water is extruded through a spinneret directly into a steam-pressurized solidification zone wherein the nascent extrudate is subjected to stretching to provide desirable physical properties for use in textile applications. Such a process is described for example, in U.S. Pat. No. 4,163,770 issued Aug. 7, 1979 to H. Porosoff. In the patent, it is taught that stretching can be completed in one or more stages but no benefits are ascribed to any particular stretching method.

In carrying out stretching in the steam-pressurized solidification zone, it has been found that the manner by which stretching is accomplished has a significant effect upon the physical properties of the ultimate fiber produced. When stretching is accomplished in a single stretch stage, a large number of strains are introduced along the polymer chain. In order to relieve the strains, it is necessary to shrink the fiber by at least about 20%. In order to provide this much shrinkage, it is necessary to relax the fiber in steam under pressure of at least about 10 pounds per square inch gauge (psig). When properly relaxed, the resulting fiber will show physical properties which are typical of prior acrylonitrile polymer fiber used for textile purposes.

It has also been found that when stretching is conducted in two stages of stretching, the second stage being conducted at a higher stretch ratio than that of the first stage, the physical properties of the relaxed fiber are superior to those of any acrylonitrile polymer fiber previously produced. However, the necessary relaxation can only be achieved using steam under pressure of at least 10 psig.

Thus, although it is possible to provide acrylonitrile polymer fiber of improved physical properties by variations in the manner by which stretching is accomplished in the steam-pressurized solidification zone, it is necessary to effect relaxation of the stretched fiber in steam under pressure of at least 10 psig to achieve the property improvements.

It would be highly desirable if a process could be provided whereby the improved physical properties were obtained by relaxation at lower steam pressures or in boiling water. The provision for such a process would overcome deficiencies of the prior art and provide a significant advance in the art.

In accordance with the present invention, there is provided a process for preparing an acrylonitrile polymer fiber which comprises extruding a single phase fusion melt of acrylonitrile polymer and water through a spinneret directly into a steam-pressurized solidification zone maintained under conditions of saturation, pressure and temperature which control the rate of release of water from the nascent extrudate and maintain the extrudate in stretchable state and stretching the extrudate while it remains within said solidification zone in at least three stretch stages, the first stage being conducted at a stretch ratio in the range of about 1.1 to 10 relative to the linear speed of the fusion melt through the spinneret, the second stages and third being conducted at a total stretch ratio greater than that of the first stage and the third and any subsequent stages being conducted at a stretch ratio that reduces steam pressure requirements for fiber relaxation.

When the spinning process is conducted in accordance with the present invention, a number of advantages arise. Increasing the number of stretches increases the extent to which stretching can be effected. Increased stretching leads to lower fiber denier without the necessity of reducing the diameter of the spinneret capillaries. Highly surprising and completely unexpected, however, is the finding that the fiber produced in accordance with the process of the present invention is readily relaxed at lower steam pressures than previously required and, in preferred embodiments, is readily relaxed in boiling water. This ease of relaxation of the stretched fiber is obtained while maintaining the high level of fiber physical properties obtained by using two or more stages of stretching.

In carrying out the processing in accordance with the present invention, a single phase fusion melt of acrylonitrile polymer and water is prepared in accordance with conventional procedure, such as described in the Porosoff reference cited above. A single phase fusion melt is obtained when proper proportions of acrylonitrile polymer and water are heated under at least autogenous pressure to a temperature above the boiling point of water at atmospheric pressure and below the deterioration temperature of the polymer. The melt obtained should be homogeneous and free of any second phase of excess water or unmelted polymer. The proper composition of water and polymer can readily be determined from a phase diagram.

Useful acrylonitrile polymers for use in carrying out the process of the present invention are those that are fiber-forming and produce fusion melts with water. Such polymers are described in the art.

After the fusion melt has been prepared, usually by means of a screw extruder, it is extruded through a spinneret assembly directly into a steam-pressurized solidification zone, maintained under conditions which control the rate of release of water from the nascent extrudate and maintain the extrudate in stretchable state. Generally, but not necessarily, saturated steam is employed at a temperature which is from about 10° C. to about 50° C. below the melting point of the polymer-water composition. Typically the steam pressure will be in the range of about 5 to about 125 pounds per square inch gauge, usually about 10 to 35 psig.

While the extrudate remains within the steam-pressurized solidification zone, it is subjected to at least three stages of stretching. Generally, the first stage of stretching will be conducted at a stretch ratio in the range of about 1.1 to 10 relative to the linear speed of fusion melt through the spinneret, preferably about 3.5 to 6.0. The second and third stages of stretching will be conducted at a total stretch ratio which is greater than that of the first stage. The third stage and any subsequent stages will be conducted at stretch ratios which reduce steam pressure requirements for fiber relaxation. It is generally preferred to conduct the stretching in three stages employing approximately equal stretch ratios in the second and third stretch stages. The total stretch ratio achieved may vary from about 25 to 150 or more depending upon the effects desired. Generally fiber physical properties are maximized at total stretch ratios of about 100 in accordance with the present invention but fiber denier continues to reduce with increasing stretch ratio as does reduction of the steam pressure necessary for fiber relaxation.

After stretching as indicated is effected, processing in accordance with the present invention is complete. However, it is generally desirable to conduct certain optional additional processing steps in order to improve physical properties of the final fiber and obtain a favorable balance of such properties. It is generally desirable to dry the stretched fiber under conditions represented by dry bulb temperatures in the range of about 110° C. to 180° C. It is also generally desirable to relax the dried fiber under conditions which result in fiber shrinkage of at least about 20%. When fiber is prepared in accordance with the process of the present invention, such shrinkage can generally be obtained by boil-off whereas following processing employing two or less stretch stages it is impossible to obtain the desired shrinkage by boil-off alone. In other instances, the process of the present invention allows the desired extent of shrinkage to be obtained under less steam pressure than is required when two or less stages of stretch are employed.

The invention is more fully illustrated in the examples which follow wherein all parts and percentages are by weight unless otherwise specified.

EXAMPLE 1

The acrylonitrile polymer was a grafted copolymer in which 84.1 parts acrylonitrile, 11.9 parts methyl methacrylate, and 0.5 part acrylamidomethylpropane sulfonic acid were polymerized in the presence of 3.5 parts of preformed polyvinyl alcohol. The polymer had a kinematic molecular weight average of 41,900.

Kinematic molecular weight average ($-M_k$) is obtained from the relationship $$\mu = \frac{1}{A} \cdot \overline{M}_k$$

wherein $\mu$ is the average effluent time in seconds for a solution of 1 gram of the polymer in 100 milliliters of 50 weight percent aqueous sodium thiocyanate solvent at 40° C. multiplied by the viscometer factor and A is the solution factor derived from a polymer of known molecular weight.

The fusion melt was obtained using 83 parts polymer, 17 parts water and 0.25 parts of a glycerol stearate type lubricant at 166° C. using a ¾ inch Brabender extruder. The spinneret plate contained 151 orifices, each of 120 micron diameter. The solidification zone was maintained with saturated steam at a pressure of 20 psig. The extrudate while it remained within the solidification zone was subjected in three runs to a fixed value of stretch ratio in a first stretch stage. Then the maximum total stretch ratio that could be obtained without significant filament breakage in a second stage of stretching was determined and finally the maximum total stretch ratio that could be obtained without significant filament breakage in a third stretch stage was determined. Results of these runs and filament denier are given in Table I.

TABLE I

FILAMENT STRETCHABILITY AT FIXED FIRST STAGE STRETCH RATIO

| Run | First Stage Stretch Ratio | Maximum Total Stretch Ratio Two Stretch Stages | Fiber Denier | Maximum Total Stretch Ratio Three Stretch Stages | Denier |
|---|---|---|---|---|---|
| 1 | 3.1 | 57 | 1.64 | 76.5 | 1.22 |
| 2 | 4.3 | 58 | 1.61 | 85.4 | 1.09 |
| 3 | 6.2 | 54 | 1.73 | 93.7 | 1.00 |

These results show that the third stage of stretching enables a larger total stretch ratio to be achieved at a given value of stretch ratio in the first stretching stage and allows finer fiber denier to be obtained.

EXAMPLE 2

The procedure of Example 1 was followed with exceptions as noted. A series of runs were made in which stretching was varied. In a first comparative run, stretching was run in two stages to provide a stretch ratio of 42. In a second run, stretching was run in three stages to a total stretch ratio of 44, comparable to that of the first run. In the third and fourth runs, stretching was in three stages to provide larger values of total stretch ratios. The fiber obtained was dried at a dry bulb temperature of 120° C. and a wet-bulb temperature of 75° C. The dried fiber was then relaxed by boil-off, then subjected to mock dyeing at 107° C. and to an additional boil-off. Fiber properties were then determined. Results are given in Table II.

TABLE II

| | Stretch Ratio | | | | Stretched Fiber Properties | | | | | | | | | |
|---|---|---|---|---|---|---|---|---|---|---|---|---|---|---|
| | | | | | Relaxation Shrinkage (%) | | | | Tenacity g/d① | | Elongation (%) | | Initial | Hot-Wet |
| Run | 1st Stage | 2nd Stage | 3rd Stage | Total | Boil-Off | Mock-Dyeing | Add. Boil-Off | Denier | Straight | Loop | Straight | Loop | Modulus② | Modulus③ |
| 1C | 3.1 | 13.5 | 0 | 42 | 12.4 | 20.7 | 20.7 | 1.4 | 5.8 | 2.1 | 25 | 13 | 42 | 0.63 |
| 2 | 3.1 | 3.74 | 3.8 | 44 | 22.6 | 24.8 | 24.8 | 1.6 | 5.6 | 2.7 | 27 | 15 | 55 | 0.84 |
| 3 | 3.1 | 3.16 | 9.2 | 90.8 | 22.6 | 25.2 | 25.2 | 1.55 | 5.0 | 3.4 | 27 | 20 | 43 | 1.25 |
| 4 | 3.1 | 18.2 | 2.8 | 158.5 | 24 | 26 | 26 | 1.06 | 4.8 | 3.5 | 28 | 22 | 44 | 1.17 |

Note:
① g/d = grams/denier
② In g/d
③ In g/d
C = Comparative

The results above show that the use of a third stretch stage produces at least 20% relaxation shrinkage as a result of boil-off whereas the use of only two stretch stages requires additional heat treatment to provide this level of relaxation shrinkage.

EXAMPLE 3

The procedure of Example 1 was again followed with the exceptions noted. In separate runs, fiber was produced at the same total stretch ratio using either two stages or three stages of stretch. In this example the total stretch ratio achieved was 33.8. The fiber was dried as in Example 2. Properties of the dried unrelaxed fiber were determined. The steam pressure necessary to effect about 30% shrinkage was determined and fiber properties after relaxation were determined. Results are given in Table III.

EXAMPLE 4

The procedure of Example 3 was again followed except that the total stretch ratio achieved was 56.25. Results are also given in Table III.

TABLE III-continued

| FIBER PROPERTIES - 2 AND 3 STRETCH STAGES | | | | |
|---|---|---|---|---|
| Run | Comp. A | Ex. 3 | Comp. B | EX. 4 |
| Init. modulus | 49.5 | 48.7 | 53.5 | 44.3 |
| Loop tenacity | 3.7 | 3.3 | 3.1 | 3.2 |
| Loop elongation | 29 | 25 | 25 | 28 |
| Hot-wet modulus | 0.61 | 0.68 | 0.64 | 0.59 |
| See Table I for units | | | | |

These results show that the use of a third stretch reduces the steam pressure requirements to provide equal relaxation shrinkage.

TABLE IV

| | STRETCH | | | | | | PHYSICAL PROPERTIES | | | | |
|---|---|---|---|---|---|---|---|---|---|---|---|
| RUN NO. | 1st | 2nd | 3rd | Tot | RELAX | DENIER | ST. TEN | ST. ELONG. | INIT. MOD. | LOOP TEN. | LOOP ELONG. |
| 1 | 2.2 | 1.8 | 11.4 | 45.8 | 31.6 | 1.39 | 4.5 | 39 | 50.4 | 3.8 | 30 |
| 2C | 21.0 | 1.8 | 1.2 | 45.8 | 29.0 | 1.85 | 2.5 | 37 | 44.6 | 1.3 | 17 |

C = Comparative
See Table I for units

EXAMPLE 5

The procedure of Example 1 was again followed except that the spinneret plate used contained 95 orifices, each of 100 micron diameter. Two runs are made, one according to the instant invention where the total stretch in the second and third stages is greater than the first stage and a comparative run wherein the first stage stretch is greater than the total stretch of the second and third stages. As can be seen in Table IV the physical properties, especially the Straight Tenacity and the Loop Tenacity are severely affected in the fiber produced in the comparative run.

TABLE III

| FIBER PROPERTIES - 2 AND 3 STRETCH STAGES | | | | |
|---|---|---|---|---|
| Run | Comp. A | Ex. 3 | Comp. B | EX. 4 |
| Stretch Ratio | | | | |
| 1st Stage | 1.92 | 1.88 | 3.75 | 3.75 |
| 2nd Stage | 17.6 | 6.0 | 15.0 | 5.0 |
| 3rd Stage | 0 | 3.0 | 0 | 3.0 |
| TOTAL | 33.8 | 33.8 | 56.25 | 56.25 |
| Unrelaxed Fiber | | | | |
| Denier | 5.6 | 5.7 | 3.3 | 3.3 |
| Str. tenacity | 5.3 | 5.1 | 4.9 | 5.4 |
| Str. elongation | 14 | 9.9 | 12.5 | 9.3 |
| Init. modulus | 106.3 | 105.0 | 115.5 | 127.3 |
| Relaxation | | | | |
| Pressure (psig) | 10.0 | 6.5 | 8.0 | 6.5 |
| Shrinkage (%) | 30.0 | 30.7 | 31.3 | |
| | | 26.4 | | |
| Relaxed Fiber | | | | |
| Denier | 6.6 | 7.8 | 4.7 | 4.8 |
| Str. tenacity | 4.9 | 5.1 | 3.2 | 4.5 |
| Str. elongation | 39 | 38 | 33 | 36 |

We claim:

1. In a process for preparing an acrylonitrile polymer fiber wherein a single phase fusion melt of acrylonitrile polymer and water is extruded through a spinnerette directly into a steam-pressurized solidification zone maintained under conditions of saturation, pressure and temperature which control the rate of release of water from the nascent extrudate and maintain the nascent extrudate in a stretchable state and stretching the extrudate while it remains within said solidification zone, the improvement which comprises conducting the stretching in at least three stretch stages, the first stage being conducted at a stretch ratio in the range of about 1.1 to 10 relative to the linear speed of the fusion melt through the spinerette, the second and third stages being conducted at a total stretch ratio greater than that of the first stage and the third and any subsequent stages being conducted at a stretch ratio that reduces steam pressure requirements for fiber relaxation.

2. The process of claim 1 including the additional step of drying the stretched extrudate at a dry bulb temperature in the range of 110° C. to 180° C. and a wet bulb temperature in the range of 60° C. to 100° C.

3. The process of claim 2 including the additional step of relaxing the dried fiber under conditions which provide a filament shrinkage of at least about 20%.

4. The process of claim 3 wherein said relaxation is carried out by boil-off.

5. The process of claim 3 wherein said relaxation is carried out in steam under pressure.

6. The process of claim 1 wherein three stretch stages are employed and the second and third stages are conducted at substantially equal stretch ratios.

7. The process of claim 1 wherein the first stretch stage is conducted at a stretch ratio of about 3.5 to 6.0.

* * * * *